US005358256A

United States Patent [19]

Kraemer

[11] Patent Number: 5,358,256

[45] Date of Patent: Oct. 25, 1994

[54] HORSESTICKS GAME ASSEMBLY AND METHOD OF PLAY

[76] Inventor: Sandy F. Kraemer, 2402 Ceresa La., Colorado Springs, Colo. 80909

[21] Appl. No.: 72,119

[22] Filed: Jun. 7, 1993

[51] Int. Cl.[5] ..... A63B 67/00

[52] U.S. Cl. ..... 273/401; 273/428

[58] Field of Search ..... 273/401, 402, 400, 336, 273/337, 341, 427, 407, DIG. 26, 428

[56] References Cited

U.S. PATENT DOCUMENTS

| | | | |
|---|---|---|---|
| 3,009,700 | 11/1961 | Dolega | 273/341 |
| 3,367,659 | 2/1968 | Lopez | 273/341 X |
| 3,947,032 | 3/1976 | Spitzer | 273/341 |
| 4,203,592 | 5/1980 | Quatkemeyer | 273/336 |
| 4,643,433 | 2/1987 | Wehby | 273/402 |
| 4,736,955 | 4/1988 | Pollock | 273/336 |
| 4,805,916 | 2/1989 | Zentner, Jr. | 273/336 |
| 5,016,891 | 5/1991 | Nelson | 273/407 |

*Primary Examiner*—William H. Grieb
*Attorney, Agent, or Firm*—Phillip A. Rein

[57] ABSTRACT

The horsesticks game assembly and method of play includes a main game target assembly associated with a scoring stick assembly. The main game target assembly includes a support base assembly to be placed a predetermined distance from a boundary line and played similar to a horseshoe game. The support base assembly is provided with a support contact base member to be placed on a support-surface and having an upwardly and inclined peripheral support wall supporting an upper deflector and scoring member. The inclined support wall is provided with an arcuate wall portion integral with a front wall portion with an entrance opening defined in the front wall portion. The upper deflector and scoring member includes a U-shaped deflector member having point scoring receiver slots thereon to receive respective ones of scoring members to score the method of play. The scoring stick assembly is provided with a pair of color coded cylindrical stick assemblies which are awarded different points such as 1) one 3 point stick member; 2) two 2 point stick members; and 3) and two 1 point stick members. The stick members are afforded greater value and point counting on being received within a central cavity of the support base assembly according to a priority scoring system.

20 Claims, 2 Drawing Sheets

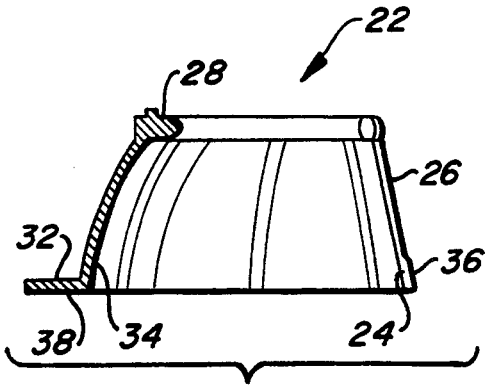
Fig_3
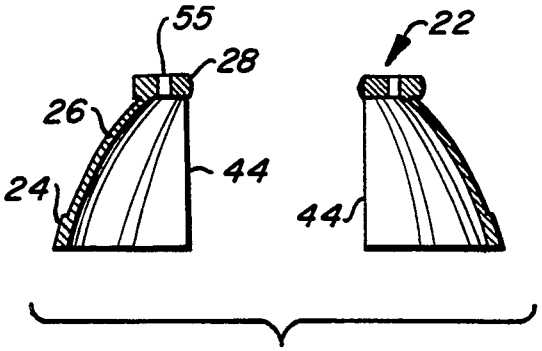
Fig_4
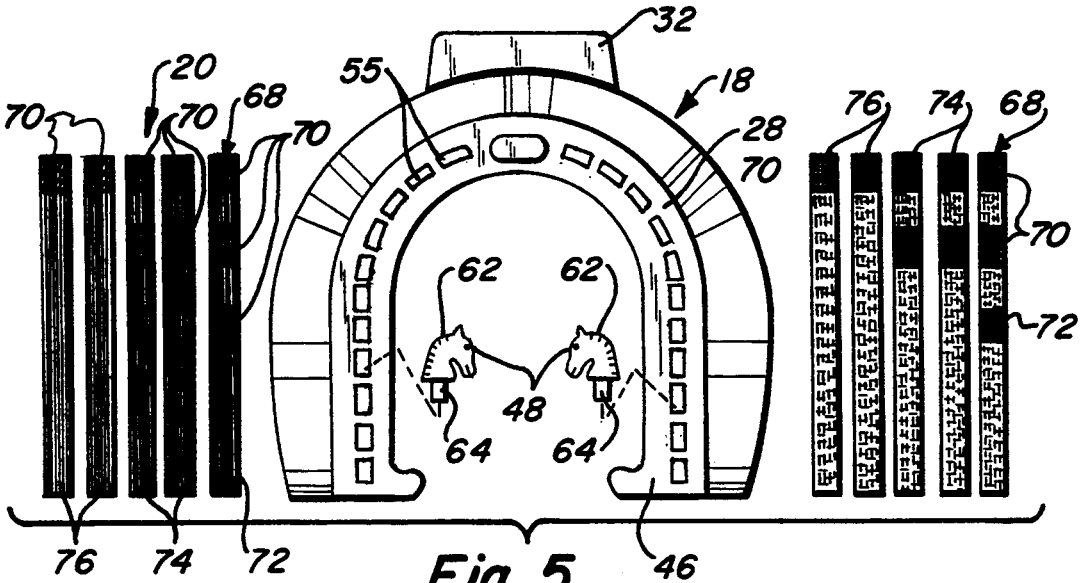
Fig_5
Fig_6
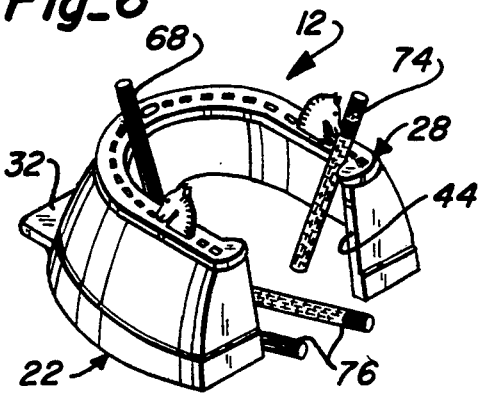
Fig_7
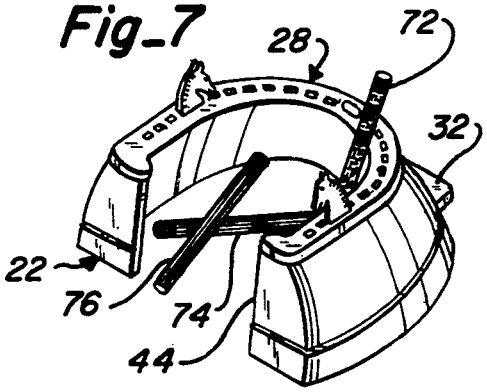

HORSESTICKS GAME ASSEMBLY AND METHOD OF PLAY

PRIOR ART

A patent search on this invention revealed the following United States patents:

| U.S Pat. No. | Invention | Inventor |
|---|---|---|
| 3,009,700 | GAME APPARATUS | Frank J. Dolega |
| 3,367,659 | GAME MISSILE AND PROJECTOR THEREFOR | Gabriel J. Lopez |
| 3,947,032 | TIP CAT APPARATUS INCLUDING TARGET AREAS | Henry W. Spitzer |
| 4,203,592 | HORSESHOE TYPE GAME DEVICE | Tony Quatkemeyer |
| 4,643,433 | TARGET GAME | Timothy A. Wehby |
| 4,736,955 | PITCH AND TOSS GAME | David G. Pollock |
| 5,016,891 | PROJECTILE-TARGET GAME APPARATUS | Donald E. Nelson |

The Dolega patent discloses a game apparatus utilizing a playing stick to propel a playing piece outwardly to land within a playing field to score points.

The Lopez patent discloses a game missile and projector which projects a missile upwardly to be caught within a net structure.

The Spitzer patent discloses a recreational apparatus having a stick which is being flipped with a rod structure.

The Pollock patent discloses a game which is played similar to a horseshoe game utilizing objects similar to a hockey puck which are thrown towards a target.

The Quatkemeyer patent discloses a horseshoe type game device whereupon rings are projected towards a mat in an attempt to place the ring in a hole to score points.

The Wehby patent discloses a target game having a scoring platform as a target and utilizing rings or discs to be thrown towards the subject target.

The Nelson patent discloses a projectile-target game apparatus whereupon palm held projectiles similar to badminton cocks are tossed in an arch for landing in a game target.

PREFERRED EMBODIMENT OF THE INVENTION

In one preferred embodiment of this invention, a horsesticks game assembly and method of play is to be utilized by two or more players and resembles in method of play a known horseshoe pitching game but having substantial dissimilarities in structure and operation. The horsesticks game assembly includes a main game target assembly or means utilized with a scoring stick assembly.

The main game target assembly includes a support base assembly comprising 1) a support contact base member; 2) an inclned support wall integral with, and extended upwardly from, the support contact base member; and 3) an upper deflector and scoring member secured about an upper edge of the inclined support wall.

The support contact base member includes an inclined base wall with 1) an arcuate wall section; 2) a front wall section; 3) a U-shaped bottom support surface; and 4) a laterally extended tab support section.

The tab support section and the bottom support surface cooperate to add stability to the main game target assembly during the method of play.

The inclined support wall includes an arcuate wall portion integral with an arcuate front wall portion with both thereof integral and extended upwardly from adjacent respective ones of the arcuate wall section and the front wall section.

The upper deflector and scoring member includes a U-shaped deflector member anchored to a top surface of the inclined support wall and having a pair of scoring members mounted thereon.

The U-shaped deflector member resembles a general horseshoe shape having 1) a central arcuate section; 2) parallel leg sections integral with the central arcuate section; 3) outer hook sections integral with outer spaced ends of the parallel leg sections; and 4) a spaced set of point scoring receivers or openings on an upper surface of the central arcuate section and the leg sections.

The outer hook sections are facing each other operable to deflect the scoring stick assemblies into a central cavity defined as within the confines of the U-shaped deflector member and the support contact base member.

The pair of scoring members are operable to be placed within the point scoring receivers or slots and may be colored and a special design such as chess pieces. Each scoring member has a design head section integral with a laterally extended support shaft or lug. The support shaft of each scoring member is operable to be placed within a respective one of the point scoring receivers to keep score of the game players during the method of play.

The scoring stick assembly includes two separate color coded sets of cylindrical stick assemblies, such as five each, to be utilized according to a color code by separate game players.

Each cylindrical stick assembly is provided with five stick members color coded for each separate game player with the sticks divided into 1) one high point stick member having a value of three (3) points; 2) two intermediate point stick members each having a value of two (2) points; and 3) two low point stick members each having a value of one (1) point.

In the method of play of the horsesticks game assembly of this invention, at least two game players are utilized with each having a cylindrical stick assembly of a respective color code. The main game target assembly is placed at a chosen distance from a starting or boundary line. The distance between the boundary line and the main game target assembly is chosen.

The main game target assembly is placed so that the front wall portion of the inclined support wall is facing and parallel to the boundary line.

In the method of play, a flip of the coin determines who will be the first player to throw a stick member from behind the boundary line toward the main target game assembly. The object of the game is to place the high point, intermediate, and low point stick members within the inner confines of the main game target assembly.

Scoring is on a higher to lower priority basis in a descending order from 1) placing the respective stick member within the entire internal confines of the main game target assembly; 2) placing a stick member within the subject internal confines but having the same protruding therefrom and resting against an upper portion of the upper deflector and scoring means; and 3) placing a stick member extended transversely of a front entrance opening of the support contact base member. With this priority scoring system, if only one stick member is completely within the internal confines of the main game target assembly, only this stick member will be counted. The stick members each have a value such as 1, 2, or 3.

In scoring of the game play, only the game player having the maximum amount of points after use of the priority scoring system will be awarded credit therefor. For example, if one game player has a total of four points and the other player has a total of three, both in the same level of the priority scoring system, only the higher total of the game player having four minus three or one will be awarded in a point score of one.

The scoring members are utilized starting from a start position adjacent the outer hook sections and are moved upwardly towards the central arcuate section of the U-shaped deflector member. Therefore, in the aforementioned scoring, the game player would move its scoring member a total of one movement in the point scoring receiver or slot.

Upon a game player reaching the uppermost scoring slot after a movement of ten spaces, the game player would reverse itself facing toward the starting point adjacent the respective outer hook sections. The first to reach the starting point after a total of twenty (20) scores would be declared the winner of this completed method of game play.

OBJECTS OF THE INVENTION

One object of this invention is to provide a horsesticks game assembly having a main game target assembly placed a distance from a boundary line and a scoring stick assembly associated therewith operable in a method of play similar to a conventional horseshoe game.

One other object of this invention is to provide a horsesticks game assembly having a main game target assembly and a pair of scoring stick assemblies operable by a method of play to provide a novel scoring system.

Another object of this invention is to provide a horsesticks game assembly including a main target assembly being a three-dimensional U-shaped target having an internal cavity operable to receive scoring stick members completely therein, upwardly inclined, and/or extended within and laterally therefrom to enjoy the method of play of this invention.

Still, another object of this invention is to provide a horsesticks game assembly having a main target assembly provided with a support base assembly having 1) a support contact base; 2) an inclined support wall extended upwardly from the support base assembly; and 3) an upper deflector and scoring member connected to an upper surface of the inclined support wall thereby providing a cavity to receive scoring stick members therein in a certain manner for scoring according to a priority scoring system and having a pair of scoring members mounted on the upper deflector and scoring member operable to be selectively movable to keep score by respective game players.

A further object of this invention is to provide a horsesticks game assembly provided with a main game target assembly of a generally U-shape with a central cavity having 1) an entrance opening to receive stick members for scoring purposes; 2) an outer inwardly inclined side wall to enclose the stick members therein in the central cavity for scoring purposes and 3) an upper deflector and scoring member having means to support or deflect the stick members to the central cavity.

Still, one further object of this invention is to provide horsesticks game assembly and method of play which is readily utilized by game players of all ages; economical to manufacture; enjoyable in the method of play; utilizing a unique priority scoring system with different point values given to stick members; and substantially maintenance free.

Various other objects, advantages, and features of the invention will become apparent to those skilled in the art from the following discussion, taken in conjunction with the accompanying drawings, in which:

FIGURES OF THE INVENTION

FIG. 3 is an enlarged sectional view taken along line 3—3 in FIG. 1;

FIG. 4 is an enlarged sectional view taken along line 4—4 in FIG. 1;

FIG. 5 is a top plan view of the horsesticks game assembly; and

FIGS. 6 and 7 are perspective views of the horsesticks game assembly illustrating methods of scoring during a method of play.

Figure 1:
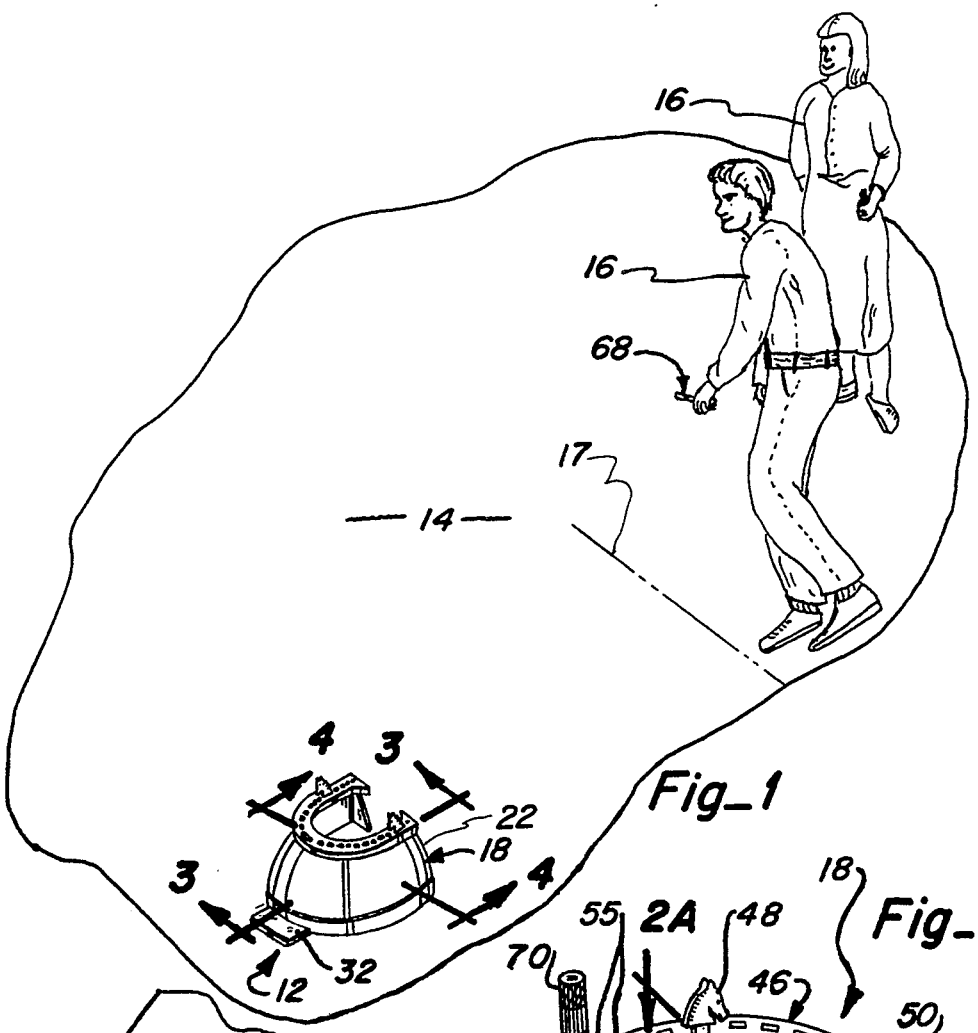
FIG. 1 is a perspective view illustrating a horsesticks game assembly and a pair of game players utilizing same in a method of play of this invention.

The following is a discussion and description of preferred specific embodiments of the horsesticks game assembly and method of play of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a horsesticks game assembly and method of play of this invention, indicated generally at 12, is utilized to be played on a support surface 14 by a pair of game players 16 who stand behind a boundary line 17 during game play for reasons to be explained. The horsesticks game assembly 12 includes a main game target assembly 18 and a scoring stick assembly 20.

In the method of play, the main game target assembly 18 is placed a predetermined distance from the boundary line 17 depending on the level of skill desired by the game players 16 utilizing same.

Figure 2A:
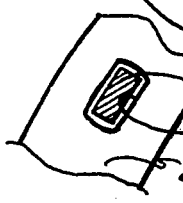
FIG. 2A is an enlarged fragmentary top plan view taken along line 2A—2A in FIG. 2.
Figure 2:
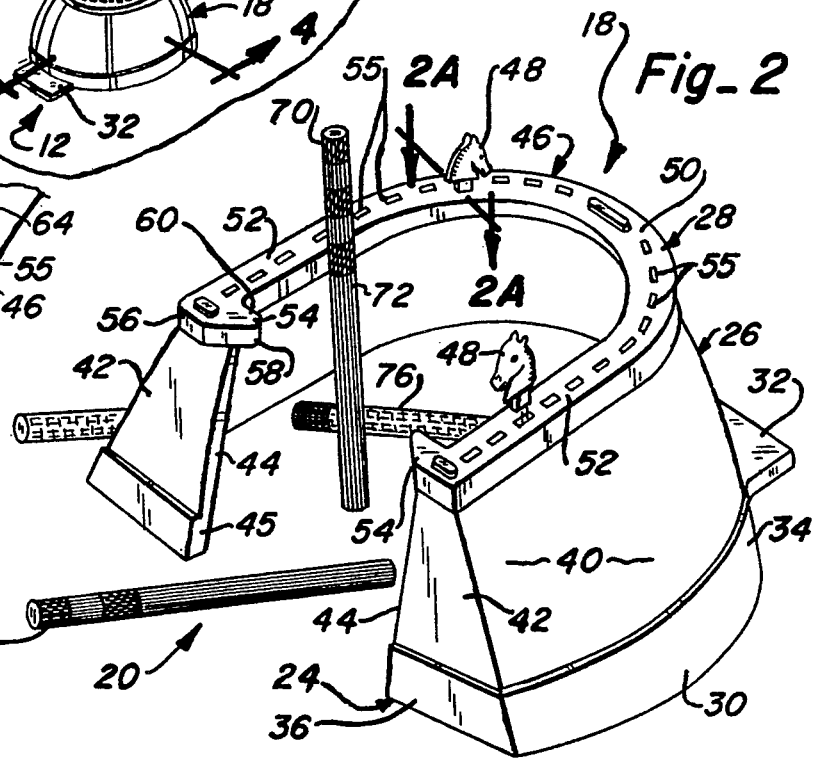
FIG. 2 is a perspective view of the horsesticks game assembly.

As noted in FIG. 2, the main game target assembly or means 18 includes a support base assembly 22. The support base assembly 22 includes 1) a support contact base member 24; 2) an inclined support wall 26 integral with the support base assembly 22 and extended upwardly therefrom; and 3) an upper deflector ant scoring member 28 secured to an upper peripheral surface of the inclined support wall 26.

The support contact base member 24 includes an inclined base wall 30 having a tab support section 32 connected thereto. The inclined base wall 30 includes an arcuate wall section 34 integral with a front wall section 36. The combined wall sections 34, 36 are of a generally horseshoe shape.

The tab support section 32 is a plate member extended laterally from the arcuate wall section 34 and positioned opposite the front wall section 36. The tab support section 32 has a lower support surface which is integral with the lower surface of the arcuate wall section 34 and the front wall section 36 in a common plane. These lower surfaces are supported on the surface 14 with the tab support section 32 aiding in preventing movement of the main game target assembly 18 during a method of play.

The inclined support wall 26 extends upwardly and inwardly from the arcuate wall section 34 and the front wall section 36 and having an arcuate front wall portion 42.

The arcuate front wall portion 42 is provided with an entrance opening 44 defined as between spaced parallel entrance end walls 45.

The upper deflector and scoring member 28 is anchored to the top peripheral surface of the arcuate wall section 34 and the arcuate front wall portion 42 and includes 1) a U-shaped deflector member 46; and 2) a pair of scoring members 48 releasably connected to the U-shaped deflector member 46.

The U-shaped deflector member 46 includes a central arcuate section 50 having outer opposed edges integral with parallel leg sections 52 which, in turn on their outer ends, are integral with outer hook sections 54. A plurality of point scoring receivers or slots 55 are extended through the U-shaped deflector member 46 and operable to receive respective ones of the scoring members 48 therein in a manner to be described.

Each outer hook section 54 is provided with an end wall portion 56 integral with a V-shaped wall portion 58 and having an inner wall surface 60. Each outer hook section 54 is of a generally irregular shape functioning in a method of play with the scoring stick assembly 20 as will be explained.

The pair of scoring members 48 may be color coded to distinguish between use by respective ones of the pair of game players 16. Each scoring member 48 includes a design head with a support shaft or lug 64. The design head section 62 can be of any shape and, in this case, is shown as a chess knight piece configuration.

As noted in FIG. 2A, the support shaft 64 is of a rectangular shape in transverse cross section and operable to be received within respective ones of the point scoring receivers or slots 55 when moving in a scoring function in the method of play as will be explained. It is noted that the rectangular shape of the support shaft 64 within the larger but similarly shaped point scoring receivers or slots 55 allow for the respective scoring members 48 to be moved forwardly or rearwardly while assuring that the scoring members 48 will not be accidentally reversed in directional movement. This is important in a scoring function in the method of play of the horsesticks game assembly 12 to maintain integrity in scoring.

On referring to FIG. 5, the scoring stick assembly 20 includes a pair of stick assemblies 68 and each of the game players 16 is assigned one set of stick members. Each set may be color coded such as one set of red colored stick members and a second set of blue colored stick members. Any marking system could be used that functions to identify a respective game player's stick assembly 68.

Each stick assembly 68 includes a plurality, namely, five stick members. Each stick member has indicia stripes 70 thereon for reasons to be explained.

More particularly, each cylindrical stick assembly 68 includes 1) one high point stick member 72 worth a value of three (3) points; 2) two intermediate point stick members 74 each having a value of two (2) points; and 3) two low point stick members 76 each having a point value of one (1) point.

The indicia stripes 70 can be of a different color, such as yellow, utilized on each one of the blue or red sets of stick assemblies 68 for each respective game player 16.

As shown in FIG. 5, 1) the low point stick members 76 are provided with one indicia stripe 70; 2) the intermediate point stick members 74 are provided with two spaced separate indicia stripes 70; and 3) each of the high point stick members 72 are provided with three spaced indicia stripes 70 for ease of identification.

In the method of play of the horsesticks game assembly 12 of this invention, the support base assembly 22 is to be placed a predetermined distance from the boundary line 17 dependent on the desired challenge and game play skill of the game players 16.

A toss of a coin could determine the first game player 16 to proceed with tossing its colored stick members 72, 74, 76 towards the support base assembly 22. The support base assembly 22 is placed a chosen distance from the boundary line 17 so as to have the front wall section 36 and the spaced entrance opening 44 facing the game players 16 in a plane parallel to the boundary line 17.

The game players 16 then would alternate in throwing the stick members 72, 74, 76 toward the support base assembly 22. The object of the game is to place the respective stick members 72, 74, 76 entirely within an interior confine or cavity of the support contact base member 24 to receive the maximum amount of points from each toss.

Another feature of the method of play of the horsesticks game assembly 12 is that, unlike a horseshoe game, the stick members 72, 74, 76 are provided with different point values 1, 2, or 3 as previously described. Therefore, it is most important that the higher values of the stick members 72, 74, 76 to be tossed, such as stick members 72, 74 will have greater impact in the priority scoring system.

The game players 16 can utilize a choice in game still by selecting the order in which the stick members 72, 74, 76 are to be tossed towards the support base assembly 22 during the method of play.

The method of play of the horsesticks game assembly 12 will be discussed hereinafter to set forth details of a method of scoring during game play.

USE AND OPERATION OF THE INVENTION

In the use and operation of the invention, the horsesticks game assembly 12 is provided with the main game target assembly 18 and the scoring stick assembly 20 having two sets of color coded ones of the cylindrical stick assemblies 68. The support base assembly 22 is placed at a predetermined distance from the boundary line 17. A coin may be flipped to determine which one of the game players 16 will proceed first in the method of play.

The support base assembly 22 is placed the predetermined distance from the boundary line 17 and having the lower surface of the support contact base member 24 and the tab support section 32 mounted on the support surface 14 normally in full contact therewith. The spaced entrance opening 44 and adjacent portion of the front wall section 36 are placed in the plane parallel to the boundary line 17.

The tab support section 32 opposite the spaced entrance opening 44 operates to provide a stabilizing effect to prevent overturning or tilting of the support base assembly 22 when impacted by the tossed stick members 72, 74, 76 of the cylindrical stick assemblies 68.

On initiating the method of play, each of the game players 16 can make decisions in regard to which order to toss their respective stick members 72, 74, 76, such as whether the high point stick member 72; one of the two intermediate point stick members 74; or one of the low point stick members 76.

The game player 16 who won the coin toss would then toss a chosen one of its stick members towards the support base assembly 22 with the primary goal to place subject stick member entirely within the confines of the support contact base member 24 with any portion thereof extended upwardly or laterally of the deflector member 46. Each game player 16 would proceed to alternate with the tossing of their stick members 72, 74, 76 towards the support base assembly 22.

After each game player 16 has thrown all of their respective cylindrical stick assemblies 68, the game players 16 will travel to the support base assembly 22 in order to determine their scoring total.

The method of scoring is that a stick member 72, 74, 76 received completely within the confines of the support contact base member 24 and below the upper U-shaped deflector member 46 would be awarded priority in scoring over all other stick members. In other words, if it was the only one within the subject confines, only this stick member would receive points depending on the indicia stripes 70 thereon to determine whether it would worth one, two, or three points.

In the method of scoring, there would also be points awarded to the respective stick members 72, 74, 76 which are inclined upwardly and resting on an inner edge of the U-shaped deflector member 46 or against the inner wall surface 60 of the respective outer hook sections 54. See stick member 72 in FIG. 2 which is the second scoring level in the priority scoring system.

In the order of the priority scoring system, the stick member points to be counted are 1) only the ones complete within the subject cavity confines; 2) if none of item 1), only the ones within subject cavity but extended upwardly and outwardly of the U-shaped deflector member 46; and 3) if none of the above, only the ones partially within and without the cavity as shown by the intermediate point stick member 74 in FIG. 2. If none of the stick members 72, 74, 76 are as described in items 1), 2), or 3) above, then no points are scored.

The scoring is cumulative whereupon all of the points obtained by a respective game player 16 are totaled and then only the game player 16 with the highest point total receives credit therefor on subtracting the lower total points of the other game players 16 therefrom.

It is noted that both of the scoring members 48 are positioned in respective point scoring slots 55 adjacent respective ones of the outer hook sections 54 on initiating a method of play.

The game player 16 with the highest or highest differential score, would move its respective scoring member 48 upwardly into the respective point scoring slots 55 and two positions of movement are shown in FIG. 6 for the left sided one of the scoring members 48.

In the priority scoring system as noted in FIG. 2, the red colored cylindrical stick assembly 68 has one stick transversing the entrance opening 44 and one stick inclined upwardly from the cavity of the support contact base member 24. The total points for this game player 16 would be five as indicated by the indicia stripes 70.

The other game player 16 has a low point stick member 76 within the cavity and the other stick member of the cylindrical stick assembly 68 is positioned outwardly of the cavity and the front wall portion 42 so as to not be accorded a scoring point. Due to the priority scoring system, this other game player 16 is awarded one point as has the only stick member completely within the confines of the cavity.

At this time, the winning game player 16 would move its respective scoring member 48 forwardly one movement to place the support shaft 64 within the respective point scoring receivers 55.

As noted in FIG. 6, it is seen therein that the red colored cylindrical stick assembly 68 has one stick member resting in an inclined position and one stick member extended outwardly of the entrance opening 44. Concurrently, the other game player 16 has an inclined stick member within the cavity extended laterally of the U-shaped deflector member 76 and another stick member extended laterally of the entrance opening 44.

On totaling these points, the red color coded game player 16 has a total of four points and the blue color coded game player 16 has a total of three points. However, due to the priority scoring system, only the inclined stick members will count. The difference between the inclined stick members is one point which would be awarded to the game player 16 using the red colored cylindrical stick assembly 68. This would be marked in the scoring by movement of the red color coded game player 16 of its respectively scoring member 48 and the support shaft 64 into the next adjacent point scoring slot 55.

As noted in FIG. 7, the red color coded game player 16 has two stick members within the cavity and the blue color coded game player 16 has one extended upwardly and inclined within the cavity and extended upwardly of the U-shaped deflector member 46.

In this case, the red color coded game player 16 has the only stick members with the cavity which will be counted for a total of three points.

The object of the horsesticks game assembly 12 is to score points by the respective game players 16 and to indicate the difference in scoring points by movement of respective ones of the scoring members 48 in their respective aligned point scoring receivers or slots 55.

Each scoring member 48 can move upwardly ten spaces until scoring member 48 is reversed and then follows the identical path downwardly for a total of twenty points. Therefore, the total of twenty points is required to win this game and the first game player 16 to obtain the required total of twenty moves or points will be declared the winner of the overall method of game play.

It is noted that the specific shape of the support base assembly 22 is important as the inclined support wall 26 functions to present the central cavity therein so that the respective stick members 72, 74, 76 thrown therein will be deflected inwardly to be retained within the central cavity instead of being dispersed outwardly to aid in the enjoyment of the method of play.

Additionally, an inner edge of the U-shaped deflector member 46 is extended inwardly of the the inclined support wall 26 being operable to deflect the stick member 72, 74, 76 inwardly plus providing an edge to support the respective stick members in an inclined point scoring position as noted in FIGS. 2, 6, and 7.

Further, the outer hook sections 54 are operable to retain any deflecting stick members 72, 74, 76 within the central cavity due to the V-shaped wall sections 58 extended inwardly from the adjoining portions of the respective parallel leg sections 52.

The horsesticks game assembly and method of play of this invention is enjoyable to play; adjustable in skill required for game players of various skills; operable to provide scoring by a difference of points to add to the skill and enjoyment thereof; provided with game stick members of various point values to add to the excitement of the game players on scoring same; economical to manufacture; and substantially maintenance free.

While the invention has been described in conjunction with preferred specific embodiments thereof, it will be understood this description is intended to illustrate and not to limit the scope of the invention, which is defined by the following claims:

I claim:

1. A main game target assembly used in a method of game play between a pair of game players similar to a horseshoe game, comprising:

a) a support base assembly including a support contact base member to rest on a ground support surface, an inclined support wall integral with and extended upwardly from said support contact base member, and an upper deflector and scoring member secured to an upper portion of said inclined support wall;

b) said upper deflector and scoring member extended inwardly of said upper portion of said inclined support wall; and c) said upper deflector and scoring member of a generally U-shape providing an opening into a cavity formed between said support contact base member and said upper deflector and scoring member to receive objects in said cavity during the method of game play.

2. A main game target assembly as described in claim 1, wherein:

a) said inclined support wall having an arcuate wall portion integral with a front wall portion extended inwardly of said arcuate wall portion; and b) said front wall portion having an entrance opening therein cooperating with said opening in said upper deflector and scoring member conjointly forming a key shaped opening to provide access of the tossed objects into said cavity.

3. A main game target assembly as described in claim 1, wherein:

a) said support contact base member having a bottom support surface and a laterally extended tab support projection having a lower support surface; and b) said lower support surface and said bottom support surface in a common plane acting to provide support on the ground support surface to provide stability against movement and tipping of said support base assembly during the method of game play on objects striking said support base assembly.

4. A main game target assembly as described in claim 1, wherein:

a) said upper deflector and scoring member has a U-shaped deflector member and a pair of scoring members releasably connected to said U-shaped deflector member; and b) said U-shaped deflector member having point scoring receivers to receive respective ones of said scoring members therein;

whereby said scoring members are moved into respective ones of said point scoring receivers in order to tabulate the relative scores of the game players during the method of game play.

5. A main game target assembly as described in claim 1, wherein:

a) said support contact base member of a generally U-shape being of a greater size than said upper deflector and scoring member, said cavity is of a concave shape, and said support wall operates to receive and maintain tossed objects within said cavity.

6. A main game target assembly as described in claim 1, including:

a) a scoring stick assembly having two sets of color coded cylindrical stick assemblies; and b) each of said cylindrical stick assemblies include one or more stick members which are to be tossed toward said cavity during the method of game play.

7. A main game target assembly as described in claim 6, wherein:

a) each of said stick members provided with one or more scoring stripes thereon which indicates a value to be assessed thereto during the method of game play and during a priority scoring system for the individual game players.

8. A horsesticks game assembly used in a method of game play between a pair of game players similar to a horseshoe game, comprising:

a) a main game target means including a support base assembly;

b) said support base assembly includes 1) a support contact base member having a U-shaped bottom support surface adapted to be supported on a ground support surface; 2) an inclined support wall secured to said support contact base member being extended upwardly and inwardly therefrom; and 3) an upper deflector and scoring member secured to an upper portion of said inclined support wall; and c) said upper deflector and scoring member includes a U-shaped deflector member having a central opening leading into a cavity between said inclined support wall;

whereby said cavity to receive tossed objects therein during the method of game play.

9. A horsesticks game assembly as described in claim 8, wherein:

a) said inclined support wall formed with a front wall portion having an entrance opening therein;

b) said front wall portion extended inwardly of adjacent connected portions of said inclined support wall; and c) said entrance opening cooperates with said deflector member to provide a combined opening into said cavity of a generally key shape.

10. A horsesticks game assembly as described in claim 8, wherein:

a) said support contact base member includes a laterally extended tab support section having a support surface lying in a common plane with said U-shaped bottom support surface to provide stability thereto and prevent tipping over and movement of said main game target means during a method of game play.

11. A horsesticks game assembly as described in claim 8, including:

a) a scoring stick assembly having a pair of cylindrical stick assemblies each having one or more stick members therein; and b) said stick members provided with indicia stripes thereon to differentiate said stick members from being a high point stick member; an intermediate point stick member; or a low point stick member.

12. A horsesticks game assembly as described in claim 8, wherein:

a) said U-shaped bottom contact support surface being similarly shaped to said deflector member except larger in size whereby said cavity is formed of an upwardly concave shape from said support contact base member to said deflector member to receive objects to be tossed therein and prevent them from being deflected outwardly therefrom.

13. A horsesticks game assembly as described in claim 8, wherein:

a) said deflector member having a central arcuate section integral with leg sections being of a general horseshoe shape; and b) said deflector member formed with a plurality of adjacent spaced point scoring receivers operable to receive a scoring member therein and being movable in a lateral direction to keep score during the method of game play.

14. A horsesticks game assembly as described in claim 13, wherein:

a) said deflector member formed with an outer hook section secured to outer portions of said leg sections and operable to deflect the objects therein during the method of game play.

15. A method of game play between a pair of game players using a horsesticks game assembly including 1) a scoring stick assembly with stick members to be tossed toward a target member in the form of a U-shaped support base assembly; 2) said stick members having scoring indicia thereon; 3) said U-shaped base assembly includes a support contact base member, an inclined support wall secured to said support contact base member being extended inwardly and upwardly therefrom, and a deflector member secured to an upper portion of said inclined support wall; 4) said inclined support wall having a front wall portion with an entrance opening; 5) said deflector member having a central opening which cooperates with said entrance opening to form a key shaped opening into a scoring cavity between said support contact base member, said inclined support wall, and said deflector member; and the method of game play comprises the following steps:

a) placing said target member a selected distance from a boundary line;

b) adjusting said target member with said front wall portion generally parallel to said boundary line;

c) supplying each game player with one or more of said stick members;

d) tossing said stick members alternately by the game players from behind said boundary line toward said target member in an attempt to place said stick members within said cavity for maximum scoring credit; and e) tabulating respective scoring credit of each game player depending on whether the tossed ones of said stick members are 1) completely within said cavity; 2) within said cavity having a portion extended upwardly of said deflector member; or 3) extended across said entrance opening; and said stick members are scored according to location relative to said cavity plus depending on respective said scoring indicia on respective ones of said stick members.

16. A method of game play as described in claim 15 having scoring members mountable within point scoring receivers in said deflector member, including:

a) placing said scoring members in respective ones of said point scoring receivers on said deflector member to indicate the relative scoring to be received by a game player during each segment in the method of game play.

17. A method of game play as described in claim 15, including:

a) returning to said boundary line by each game player with their respective said stick members and proceeding the aforementioned steps on repeating another segment of the method of game play of this invention.

18. A horsesticks game assembly used in a method of game play between a pair of game players similar to a horseshoe game, comprising:

a) a main game target means including a support base assembly;

b) said support base assembly includes 1) a support contact base member having a U-shaped bottom support surface adapted to be supported on a ground support surface; 2) a support wall secured to said support contact base member being extended upwardly therefrom; and 3) an upper deflector and scoring member secured to, and extended inwardly of, an upper portion of said inclined support wall; and c) said upper deflector and scoring member includes a deflector member having a central opening leading into a cavity between said inclined support wall;

whereby said cavity to receive tossed objects therein during the method of game play.

19. A horsesticks game assembly as described in claim 18, wherein:

a) said support wall includes a wall section connected to a front wall portion having an entrance opening therein;

b) said front wall portion extended inwardly of adjacent connected portions of said wall section; and c) said entrance opening cooperates with said deflector member to provide a combined opening into said cavity of a generally key shape.

20. A horsesticks game assembly as described in claim 18, wherein:

a) said support contact base member having a laterally extended tab support projection having a lower support surface; and b) said lower support surface and said bottom support surface acting to provide support on the ground support surface to provide stability against movement and tipping of said support base assembly during the method of game play on objects striking said support base assembly.

* * * * *